United States Patent [19]

Mor

[11] Patent Number: 4,559,844

[45] Date of Patent: Dec. 24, 1985

[54] SINGLE-LEVER STRAIGHT-LINE MOTION DEVICE FOR SINGLE, DOUBLE AND CROSSED DRIVE ON HYDRAULIC PILOT DEVICES

[75] Inventor: Pietro Mor, Imola, Italy

[73] Assignee: Hidroben S.p.A. Componenti ed Impianti Oleodinamici, Casalfiumanese, Italy

[21] Appl. No.: 391,463

[22] Filed: Jun. 23, 1982

[30] Foreign Application Priority Data

Apr. 23, 1982 [EP] European Pat. Off. ..... 82830109.3

[51] Int. Cl.[4] ..... G05G 9/04

[52] U.S. Cl. ..... 74/471 R; 74/491; 137/636.3; 180/6.48; 180/333

[58] Field of Search ..... 74/471 R, 491, 471 XY; 137/636.3, 867, 868; 180/6.48, 333; 200/17 R

[56] References Cited

U.S. PATENT DOCUMENTS

| | | | |
|---|---|---|---|
| 2,387,008 | 10/1945 | Buchanan | 74/471 |
| 2,591,293 | 4/1952 | Reeves | 74/471 XY |
| 3,055,445 | 9/1962 | Mendez et al. | 74/471 R |
| 3,131,573 | 5/1964 | Bent | 74/471 |
| 3,321,990 | 5/1967 | Densmore | 137/636.3 |
| 3,407,682 | 10/1968 | Yoshizawa et al. | 74/471 |
| 3,496,796 | 2/1970 | Alphers et al. | 74/471 XY |
| 3,540,220 | 11/1970 | Lauck | 60/19 |
| 3,541,876 | 11/1970 | Gressard | 74/471 R |
| 3,543,871 | 12/1970 | Klaue | 74/471 R |
| 3,611,827 | 10/1971 | Bottum et al. | 74/471 |
| 3,776,325 | 12/1973 | Jespersen | 74/471 R |
| 3,876,020 | 4/1975 | Barsby | 74/471 R |
| 3,877,538 | 4/1975 | Steiger | 180/6.48 |
| 4,111,066 | 9/1978 | Kendrick | 74/471 R |

FOREIGN PATENT DOCUMENTS

| | | | |
|---|---|---|---|
| 709646 | 5/1965 | Canada | 74/471 |
| 0038649 | 10/1981 | European Pat. Off. . | |
| 2842483 | 5/1980 | Fed. Rep. of Germany . | |
| 2127711 | 10/1972 | France . | |
| 2205037 | 5/1974 | France . | |

*Primary Examiner*—Allan D. Herrmann

*Attorney, Agent, or Firm*—Stevens, Davis, Miller & Mosher

[57] ABSTRACT

A straight-line motion device is described for controlling hydraulic control devices, which is activated by a single lever.

The above straight-line motion device is supported by the piloting device body 22 of the said hydraulic control by means of the fork 20. The body 22 contains the operating system parts, including four pushers 25, 26, 27 and 28, protruding from the body 22 to then come into contact with cams 16 and 17. These cams operate pushers 26 and 27 and pushers 25 and 28 respectively.

The main feature of the invention is that cams 15 and 16 are operated by a straight-line motion device controlled by a single lever 1.

7 Claims, 6 Drawing Figures

SINGLE-LEVER STRAIGHT-LINE MOTION DEVICE FOR SINGLE, DOUBLE AND CROSSED DRIVE ON HYDRAULIC PILOT DEVICES

The invention relates to a straight-line motion device operated by a single lever for controlling a pilot device of, for example, distributors, pumps, etc. in machines with provision for the use of hydraulic power actuators. Straight-line motion devices of the above type are well-known at present. They consist of first lever-type parts at the operator's disposal which act on the oleodynamic or hydraulic operating circuits of the machine.

The above first parts generally consist of two levers, with handgrips for the operator, each of which operates its own cam. Following the movement of the given lever, the subsequent operating of each cam brings about the movement of the parts of the machine operating system, thus controlling the machine itself.

The presence of the two levers makes it difficult for the operator to perform piloting operations on the machine, since he must operate the two levers with only one hand. Operating is particularly difficult and awkward in a double crossed drive, where the first lever must be set forward and the second one back, since this may cause inaccuracy in operating and since it requires particularly close attention by the operator, leading to fatigue.

This invention has for its object to remedy this incovenience. As outlined below, the invention solves the problem of creating a pilot device for a machine of the above type by having a straight-line motion device controlling the oleodynamic operating parts. This can be operated by one single lever which acts by means of the above straight-line motion device on the oleodynamic operating circuit, according to the positions into which the operator puts the lever.

The advantages obtained with this invention are basically that the operator can use a pilot instrument which is simpler than those already known, which is not subject to the risk of inaccuracy in operating; and which can easily follow the operator's movements. Another advantage of this invention lies in the fact that the construction of the above-mentioned part is more compact.

The invention will now be described in greater detail. Reference will be made to the drawings which show a preferred arrangement.

Figure 1:
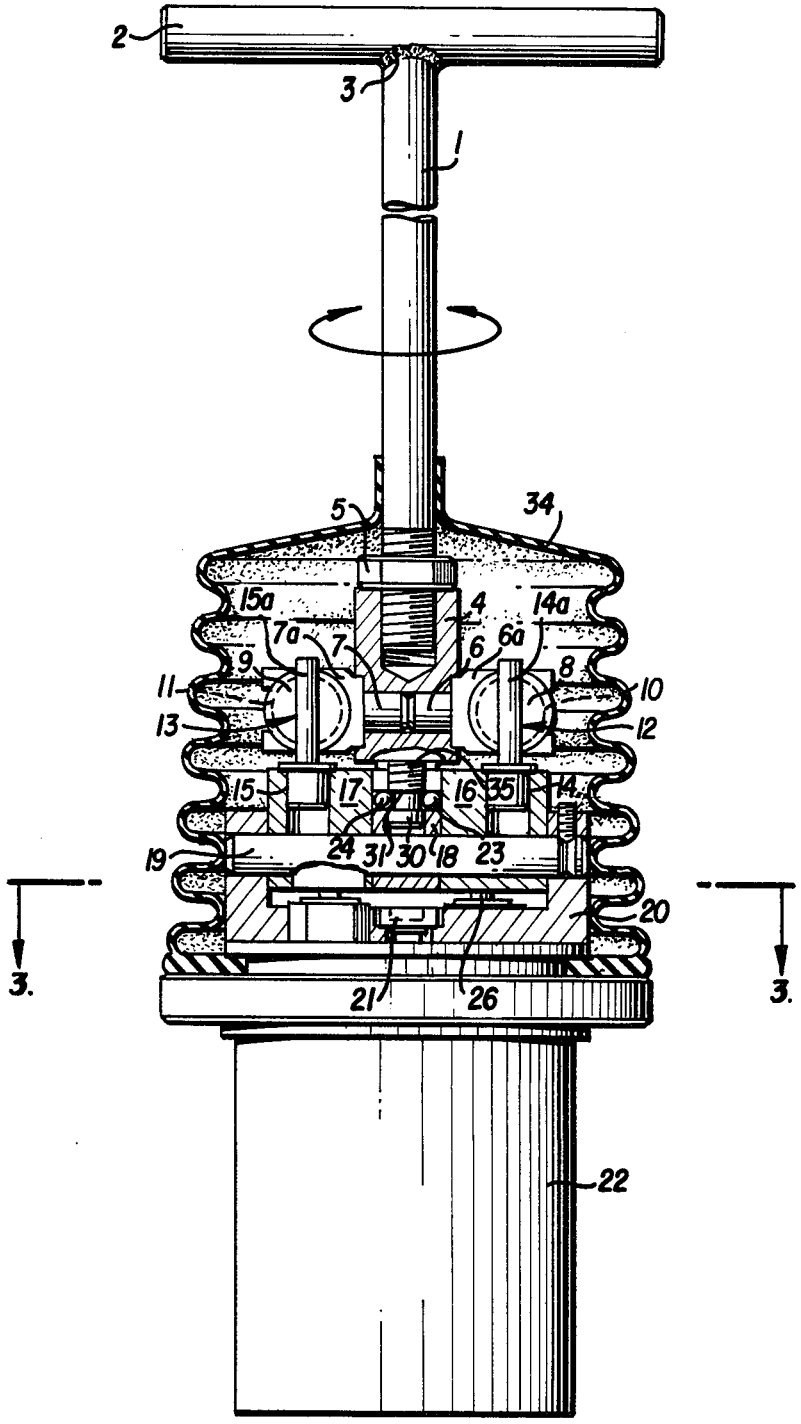
FIG. 1 shows a partial orthogonal section of the straight-line motion device according to this invention. The straight-line motion device rests on the upper part of the pilot device.

For example, the pilot device may be mounted on tracked vehicles which are piloted by the operator via the oleodynamic parts which act separately on the tracks. At the operator's command, the vehicle advances in a straight line when the two tracks roll together. It steers left when the left track remains stationary with only the right track moving and, vice-versa, it steers right with the right track stationary and the left moving; it turns on its axis when each track is moving in the direction opposite to the other. The device shown in the above figures consists basically of a pilot device carrier 22, upon which the straight-line motion device, of the present invention is placed. This straight-line motion device is encased within a bellows-type flexible protective casing 34 and consists of a lever 1, with a T-shaped handgrip 2 which is made integral with the lever, such as by means of a welded joint 3.

The lower part of lever 1 is screwed onto a bushing support 4, to which it is fixed by means of a lock nut 5. This prevents vibrations unscrewing the lever 1.

Two cylindrical elements 6 and 7 are inserted in bushing 4. These elements are free to rotate on their own axis. At the ends of elements 6 and 7 there are two forks, indicated by **6*a* and 7*a* respectively. Fork 6*a* is inserted in a circumferential groove 10 of a first sphere 8 and fork 7*a* is similarly inserted in a circumferential groove 11 of a second sphere 9. A structure is thus produced which permits the guided traverse of the two spheres 8 and 9, in a radial direction with center in the axis of symmetry of bushing 4. Sphere 8 has a second circumferential groove 12 which extends orthogonally with respect to the plane of the first groove 10 and which houses a fork 14*a* protruding from a gudgeon pin 14. In the same way, sphere 9 has a circumferential groove 13 which extends orthogonally with respect to the plane of the first groove 11 and which houses a fork 15*a* protruding from a second gudgeon pin 15**.

Gudgeon pins 14 and 15 are inserted repectively in housings in the body of two cams, 16 and 17, each remaining free to rotate on its own axis.

A spindle 30 forms a downward extension of bushing 4 and is housed threadly via threads 35, in a cylindrical ring 18.

Figure 4:
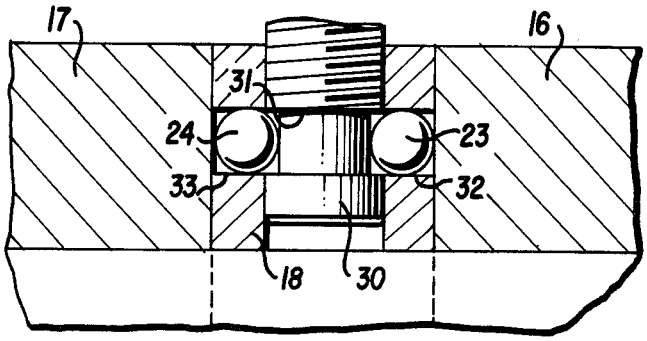
FIG. 4 shows details of the structural relationship between the cams, the spindel and the cylindrical ring according to the present invention.
Figure 5:
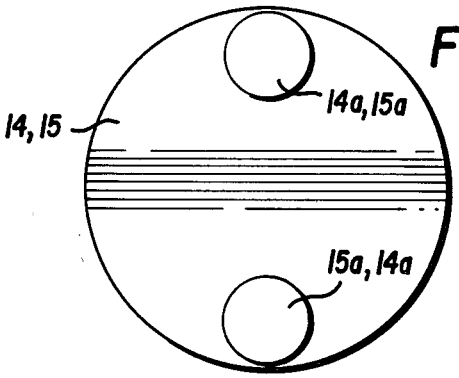
FIG. 5 is a top view of a gudgeon pin and its fork-shaped end portion according to the present invention.
Figure 6:
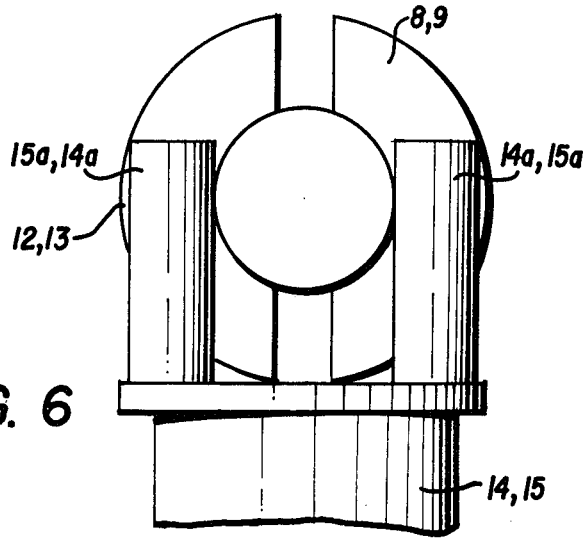
FIG. 6 is a side view of a gudgeon pin and its fork-shaped end portion, in a circumferential groove in a spherical element according to the present invention.

The cylindrical ring 18 and the two cams 16 and 17 are hinged onto an axle 19 which is turn is fixed to a support fork 20, clamped to the central body of the pilot device 22 by means of screws 21. The ring 18 and the two cams 16 and 17 can thus rotate around axle 19. To balance spindle 30 within ring 18 so as to prevent them from coming unscrewed and to allow rotation of lever 1, spindle 30 has a spherical groove 31 which houses part of spheres 23 and 24. The remainder of these spheres are inserted respectively into two holes 32 and 33 as shown in FIG. 4, drilled in ring 18. Spheres 23 and 24 come into contact with cams 16 and 17 respectively. Cam 16 comes into contact with two pushers 26 and 27, in order to operate them and cam 17 likewise comes into contact with pushers 25 and 28 to operate them. These pushers project from the central body 22 of the pilot device.

In explaining how the straight-line motion device works, it is presumed that what occurs inside the pilot device 22 is known. This device contains oleodynamic parts and elements for operating the tracked vehicle.

This vehicle is operated in the following various ways. To drive the vehicle in a straight line, the operator moves lever 1 forward which rotates on axle 19. This results in a movement of bushing 4 and of cylindrical elements 6 and 7. Their respective forks **6*a* and 7*a* transmit the movement to forks 14*a* and 15*a* of pins 14 and 15, causing cams 16 and 17 to rotate together. The pushers 26 and 25** are thus lowered and the vehicle consequently moves forward in a straight line.

By moving the lever in the opposite direction, the pushers 27 and 28 are lowered and the vehicle consequently moves backwards in a straight line.

Only one cam, for example cam 16, need be operated to steer the vehicle which requires lever 1 to be simultaneously pushed forward and rotated in certain direction, e.g. counter-clockwise. This latter movement is made possible by the balancing of the spindle 30 on ring 18 by means of spheres 23 and 24.

By rotating lever 1, fork 6*a* is moved forward in a counter-clockwise direction with respect to the drawing plane.

Sphere 8 moves outwards to follow the guide determined by the fork 14*a*. The latter is forced to follow the movement defined by the rotation of lever 1, as well as to rotate counter-clockwise on the axis of gudgeon pin 14. Vice-versa, following rotation of lever 1, fork 7*a* moves in an acounter-clockwise direction backwards with respect to the drawing plane. Sphere 9 moves outwards to follow the guide determined by the fork 15*a*, whose gudgeon pin 15 rotates in a counter-clockwise direction in its own housing. Fork 7*a* in fact remains in its own position with respect to the drawing plane since its backward movement due to the rotation of lever 1 is equal to its forward movement caused by the forward movement of the lever 1.

In this way, only pusher 26 is lowered to steer the vehicle towards the left, for example. To steer the vehicle towards the right, pusher 25 is moved by rotating lever 1 clockwise through a certain angle while it is being moved forward. When it is necessary to make the vehicle turn on its own axis, cams 16 and 17 must be rotated in opposite directions. For example, the operator does this by rotating lever 1 clockwise on its own axis through a predetermined angle. Rotation is followed by the balancing of spindle 30 in ring 18, the consequence being that spheres 8 and 9 move horizontally outwards to follow the guide of the forks 14*a* and 15*a*. These two spheres also move vertically on forks 14*a* and 15*a*. Besides rotating each on its own axis, one of the gudgeon pins 14 and 15 moves forwards and the other moves backwards with respect to the drawing plane, making cams 16 and 17 rotate in opposite directions to each other with respect to axle 19, thus lowering pushers 27 and 25. Pushers 26 and 28 are lowered by rotating the lever in a counter-clockwise direction, to make the vehicle turn the opposite way.

Figure 2:
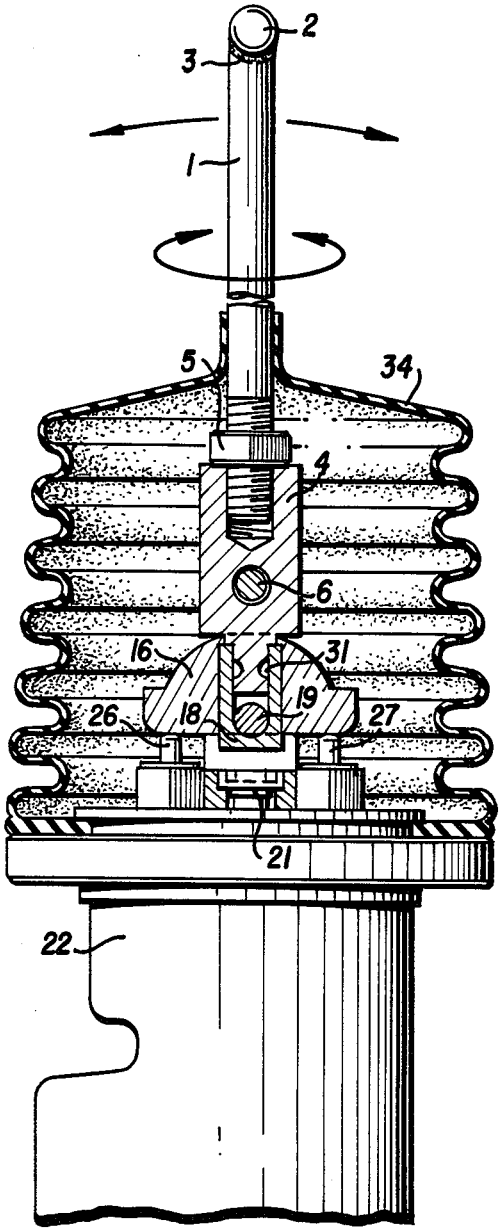
FIG. 2 shows a partial orthogonal section of the side view of the straight-line motion device.
Figure 3:
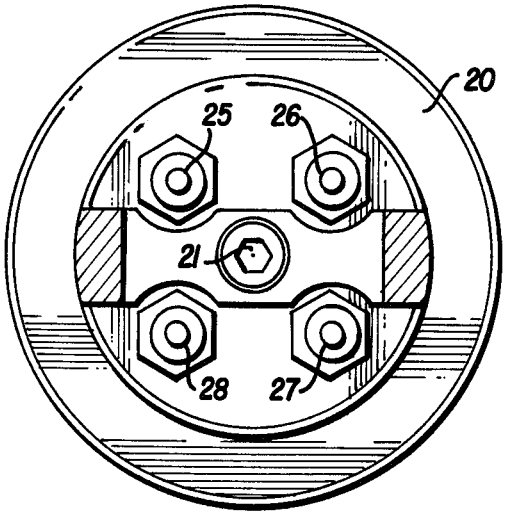
FIG. 3 shows a section of the same straight-line motion device along the line 3—3 of FIG. 1.

Construction variations which solve the problem of moving the vehicle by means of single-lever devices can be made according to the arrangement described and illustrated in FIGS. 1, 2 and 3.

In particular, spheres 8 and 9 may be removed completely, since they solve the problem of keeping the movements more precise with respect to forks 6*a* and 7*a*, reducing friction and stopping them from knocking together. The fork-shape of parts 14*a*, 15*a*, 6*a* and 7*a* is useful in preventing their reciprocal disengagement. On the other hand, spheres 8 and 9 may each be replaced by a self-aligning cage bearing, the internal ring of which contains with precision a horizontal pin supported by bushing 4. These bearings are part of elements 14 and 15 hinged in cams 16 and 17.

I claim:

1. A single lever straight line device capable of being operated by a single lever and being supported on a piloting device body by means of a support fork projecting from a top side of said piloting device body, said piloting device body including at least four pushers extending from a top side of said piloting device body, said lever being rotatably disposed with respect to said piloting device body and with respect to a longitudinal axis of said lever, said straight line device including:

(a) a pair of cams rotatably disposed with respect to said piloting device body, each said cam for operatively contacting a respective pair of said pushers;

(b) a pair of pin members, each housed within a respective said cam and protruding upwardly from a top surface of said cam in which it is housed;

(c) a pair of elongated elements disposed along an oblique axis relative to a longitudinal axis of said lever, said elongated elements being constrained to move with said lever, said elongated elements transmitting movement of said lever to said pin members housed within said cams, such that said pin members undergo congruent motion with respect to said elongated elements, said elongated elements and said pin members being rotatably disposed relative to said piloting device body, each said pin member having a fork-shaped portion and each said elongated element having fork-shaped end portions of each end thereof; and (d) first and second spherical elements, each having a first circumferential groove housing a said fork-shaped end portion of a said elongated element and a second circumferential groove housing a said fork-shaped portion of a said pin member.

2. The single lever straight line device as in claim 1, wherein said fork-shaped portions and said fork-shaped end portions include means for preventing disengagement of said elongated elements from said pin members.

3. A single lever straight line device capable of being operated by a single lever and being supported on a piloting device body by means of a support fork projecting from a top side of said piloting device body, said piloting device body including at least four pushers extending from a top side of said piloting device body, said lever being rotatably disposed with respect to said piloting device body and with respect to a longitudinal axis of said lever, said straight line device including:

(a) a pair of cams rotatably disposed with respect to said piloting device body, each said cam for operatively contacting a respective pair of said pushers;

(b) a spindle protruding from a lower end of said lever, said spindle and said lever having a common longitudinal axis; and (c) a ring element in which said spindle is housed, such that said spindle can rotate with respect to said longitudinal axis of said spindle and said lever, said spindle having a circumferential groove for partially receiving a pair of spherical elements, said ring having a pair of through-holes disposed adjacent said circumferential groove of said spindle, said through-holes partially receiving respective ones of said spherical elements, each said spherical element extending beyond an extremity of a said through-hole to contact a said cam.

4. A single lever straight line device capable of being operated by a single lever and being supported on a piloting device body by means of a support fork projecting from a top side of said piloting device body, said piloting device body including at least four pushers extending from a top side of said piloting device body, said lever being rotatably disposed with respect to said piloting device body relative to an axis substantially perpendicular to said longitudinal axis of said lever and with respect to a longitudinal axis of said lever, said straight line device including:

(a) a pair of cams rotatably disposed with respect to said piloting device body, each said cam for operatively contacting a respective pair of said pushers;

(b) a pair of pin members, each housed within a respective said cam, each pin member being rotatable relative to its longitudinal axis and including a fork-shaped end portion protruding upwardly from a top surface of a said cam in which it is housed;

(c) a pair of elongated elements each constrained to move with said lever relative to said piloting device body both when said lever rotates relative to said longitudinal axis of said lever and when said lever rotates with respect to said piloting device body relative to said substantially perpendicular axis, each elongated element being free to rotate relative to a longitudinal axis thereof which is disposed substantially perpendicular to said longitudinal axis of said lever, each elongated element having a fork-shaped end portion; and (d) first and second spherical elements, each having a first circumferential groove housing a said fork-shaped end portion of a said elongated element and a second circumferential groove perpendicular to a said first groove and housing a said fork-shaped end portion of a said pin member.

5. The single lever straight line device as in claim 4, wherein said fork-shaped end portions of said elongated elements and said fork-shaped portions of said pin members include means for preventing disengagement of said elongated elements from said pin members.

6. The single lever straight line device as in claim 3, further comprising:

(a) a pair of elongated elements disposed along an oblique axis relative to a longitudinal axis of said lever, said elongated elements being free to rotate around said oblique axis and being constrained to move with said lever, said elongated elements transmitting movement of said lever to said pin members housed within said cams such that said pin members undergo congruent motion with respect to said elongated elements, said pin members being rotatably disposed relative to said piloting device body, ech said pin member having a fork-shaped portion, each said elongated element having a fork-shaped end portion; and (b) first and second spherical elements, each having a first circumferential groove housing a said fork-shaped end portion of a said elongated element and a second circumferential groove housing a said fork-shaped portion of a said pin member.

7. The single lever straight line device as in claim 3, wherein said fork-shaped portions and said fork-shaped end portions include means for preventing disengagement of said elongated element from said pin members.

* * * * *